US007665458B2

(12) United States Patent
Waltz et al.

(10) Patent No.: US 7,665,458 B2
(45) Date of Patent: Feb. 23, 2010

(54) OVERFIRE AIR TUBE DAMPER FOR BOILER AND METHOD FOR REGULATING OVERFIRE AIR

(75) Inventors: Robert W. Waltz, Canton, OH (US); Quang H. Nguyen, Aliso Viego, CA (US)

(73) Assignee: General Electric Company, Schenectady, NY (US)

( * ) Notice: Subject to any disclaimer, the term of this patent is extended or adjusted under 35 U.S.C. 154(b) by 132 days.

(21) Appl. No.: 11/749,535

(22) Filed: May 16, 2007

(65) Prior Publication Data

US 2008/0283039 A1 Nov. 20, 2008

(51) Int. Cl.
*F23D 11/00* (2006.01)

(52) U.S. Cl. ..... 126/290; 126/530; 126/534; 126/549; 126/285 R; 60/295; 60/297; 110/147; 110/160

(58) Field of Classification Search ..... 126/290, 126/549, 285 R; 110/147, 160, 260–263
See application file for complete search history.

(56) References Cited

U.S. PATENT DOCUMENTS 823,836 A * 6/1906 Wiemann ..... 431/186
1,976,208 A * 10/1934 Agthe et al. ..... 239/404
4,381,718 A * 5/1983 Carver et al. ..... 110/347
5,199,355 A * 4/1993 Larue ..... 110/261
5,205,226 A * 4/1993 Kitto et al. ..... 110/264
5,724,897 A * 3/1998 Breen et al. ..... 110/261
5,944,506 A * 8/1999 Kamal et al. ..... 431/159
7,047,891 B2 * 5/2006 Vatsky ..... 110/297
2003/0145768 A1 * 8/2003 Vatsky ..... 110/297
2004/0244367 A1 * 12/2004 Swanson et al. ..... 60/295

* cited by examiner

*Primary Examiner*—Steven B McAllister
*Assistant Examiner*—Nikhil Mashruwala
(74) *Attorney, Agent, or Firm*—Nixon & Vanderhye P.C.

(57) ABSTRACT

A damper and overfire air duct in a combustion system having a combustion structure defining a flue gas passage, the damper and overfire air duct including: an inlet to the overfire air duct and an outlet to the duct discharging overfire air into the flue gas passage, and the damper aligned with an axis of the overfire air duct, and having an open position axially distal to the inlet and a closed position at least partially in the inlet and duct, wherein the damper is movable axially between the open and closed positions.

14 Claims, 4 Drawing Sheets

OVERFIRE AIR TUBE DAMPER FOR BOILER AND METHOD FOR REGULATING OVERFIRE AIR

BACKGROUND OF THE INVENTION

This invention relates generally to secondary air injection to combustion systems and, particularly, to dampers for secondary air tubes in fossil fuel fired boilers.

Combustion systems are used in numerous industrial environments to generate heat and hot gases. For example, boilers and furnaces burn hydrocarbon fuels, e.g., oil and coal, in stationary combustors to produce heat to raise the temperature of a fluid, e.g., water. Industrial combustors typically employ various burner elements to combust the fuel and air injectors to provide combustion air to ensure complete combustion of the fuel. A typical industrial furnace, whether gas or fossil fired and hereafter referred to as a boiler, typically includes a lower combustion zone and a generally vertically extending flue gas passage.

The air introduced into a combustion system may be staged. Primary air is mixed with the fuel as both are injected into a combustion zone. Secondary air (also known as overfire air) may be injected into a combustion chamber downstream (in the direction of flue gas flow) of the primary combustion zone. The secondary air may be used to burnout any unburned hydrocarbons remaining from the primary combustion zone.

Overfire air is typically injected into the flue gas at a location in the flue gas passage downstream of the combustion zone. The combustion air provided to the combustion zone may be reduced to suppress flame temperature in the combustion zone and NOx formation. Suppressing combustion temperature creates excessive unburned hydrocarbons in the flue gas. The overfire air, introduced above the primary combustion zone, completes combustion of the unburned hydrocarbons which are then converted to carbon dioxide and water.

In conventional boilers, the overfire air is introduced to the flue passage through injection ports in the front or side walls or both of the boiler. The amount of secondary air (overfire air) needed for effective burnout may vary depending on the operating condition of the combustion system. To adjust the amount of secondary air, dampers are closed or opened to vary the amount of secondary air flowing from the secondary air tubes into the flue passage. However, conventional dampers tend to either shut off secondary air flow or allow substantial amounts of air flow. Conventional dampers tend not to effectively allow for adjustable amounts of secondary air. There is a long felt need for an improved damper for a secondary (overfire) air system.

BRIEF DESCRIPTION OF THE INVENTION

A damper and overfire air duct has been developed for a combustion system having a combustion structure defining a flue gas passage, the damper and overfire air duct including: an inlet to the overfire air duct and an outlet to the duct discharging overfire air into the flue gas passage, and the damper aligned with an axis of the overfire air duct, and having an open position axially distal to the inlet and a closed position at least partially in the inlet and duct, wherein the damper is movable axially between the open and closed positions.

An overfire air duct has been developed for a combustion system having a combustion structure defining a flue gas passage, the damper and overfire air duct comprising: an inlet to the overfire air duct and an outlet to the duct discharging overfire air into the flue gas passage, and the damper aligned with an axis of the overfire air duct, and having an open position axially distal to the inlet and a closed position at least partially in the inlet and duct, wherein the damper is movable axially between the open and closed positions.

A method has been developed to regulate overfire air passing through an overfire air duct and entering a flue gas stream in a combustion system, the method comprising: directing overfire air into an inlet of the overfire air duct, passing the overfire air through the duct and discharging the overfire air into the flue gas stream in the combustion system; adjusting a flow rate of overfire air entering the inlet using a damper adjacent the inlet; moving the damper parallel to an axis of the overfire air duct to increase and decrease the overfire air entering the inlet, wherein the damper having an open position at which the damper is extended out of the inlet and a closed position in which the damper is substantially in the inlet and blocking air entering the inlet.

DETAILED DESCRIPTION OF THE INVENTION

Figure 1:
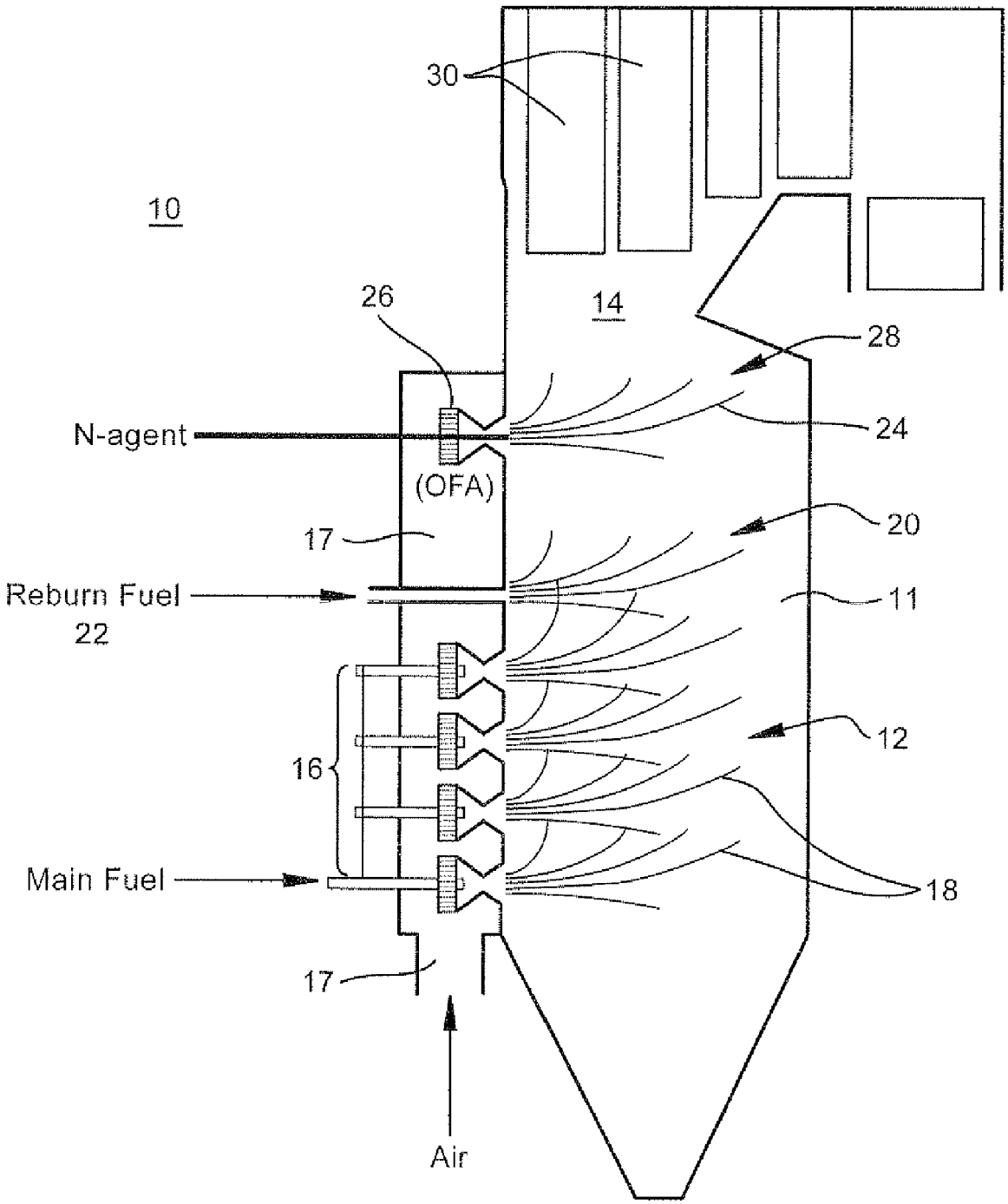
FIG. 1 is a schematic diagram showing a side, cross-sectional view of a combustion system.

FIG. 1 is schematic diagram of a combustion system 10, e.g., a boiler, with a sidewall removed to show the interior combustion zone 12 and flue gas duct 14. The combustion system 10 may be a large hollow structure 11, that is more than one, two or even three hundred feet tall. The combustion system 10 may include a plurality of combustion devices 16, e.g., an assembly of combustion fuel nozzles and air injectors, which mix fuel and air to generate flame in the combustion zone 12. The combustion device 16 may include burners, e.g., gas-fired burners, coal-fired burners and oil-fired burners. The burners may be arranged on one or more walls, e.g., front and back walls, of the structure 11 of the combustion system 10. The burners may be situated in a wall-fired, opposite-fired, tangential-fired, or cyclone arrangement, and may be arranged to generate a plurality of distinct flames, a common fireball, or any combination thereof. Air for the burners may flow through an air duct(s) 17 on an outside wall(s) of the structure 11.

The fuel/air mixture 18 injected by the combustion devices 16 burns primarily in the combustion zone 12 and generates hot combustion gases that flow upward through the flue gas passage 14. From the combustion zone 12, the hot combustion gases flow into an optional reburn zone 20 into which additional (reburn) fuel 22 is supplied to the hot combustion gases to promote additional combustion.

Downstream of combustion and reburn zones, overfire air (OFA) 24 is injected through an overfire air nozzle(s) 26 into the OFA burnout zone 28 in the flue gas stream. A reducing agent, e.g., nitrogen (N-agent), may be injected into the flue gases with one or more of the streams of overfire air. Downstream of the OFA burnout zone, the combustion flue gas 24 passes through a series of heat exchangers 30 and a particulate control device (not shown), such as an electrostatic precipitator (ESP) or baghouse, that removes solid particles from the flue gas, such as fly ash.

Figure 2:
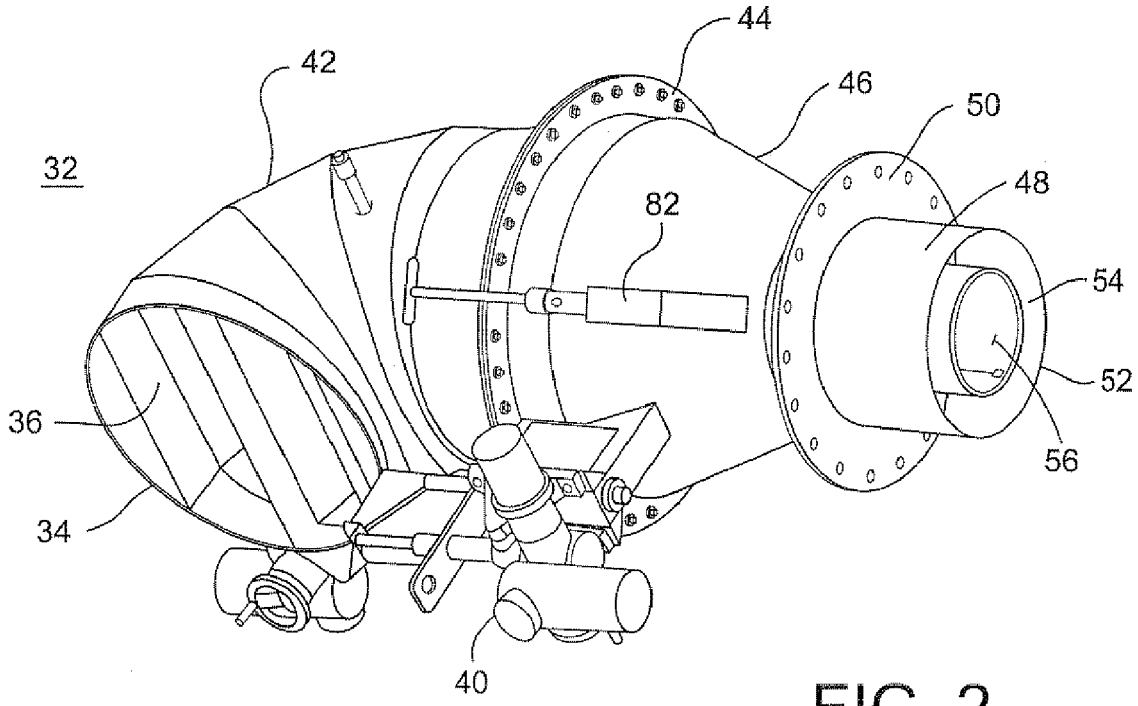
FIG. 2 is a perspective view of an overfire air injector assembly.
Figure 3:
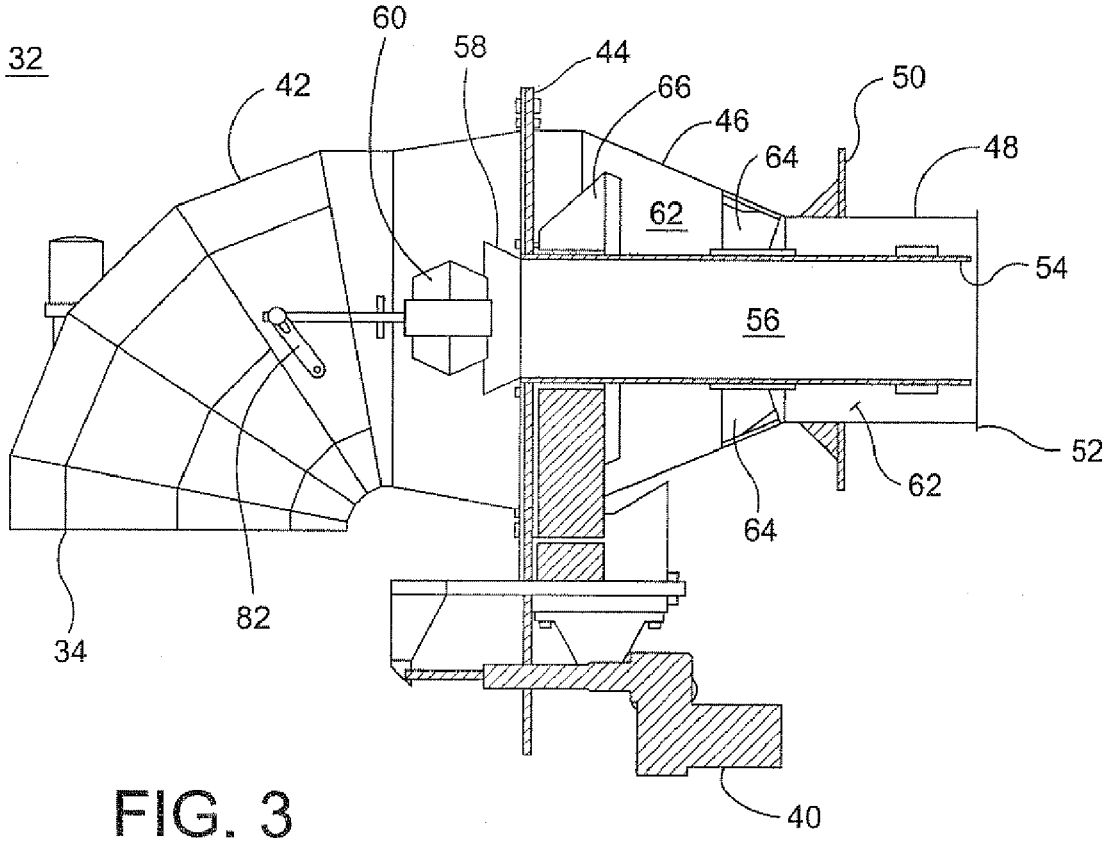
FIG. 3 is a side view, show in partial cross-section, of the overfire air injector assembly shown in FIG. 2.

FIG. 2 is a perspective view and FIG. 3 is a side view, show in partial cross-section, of an overfire air injector assembly 32. The air injector assembly forms the structure for the overfire air nozzles 26 shown in FIG. 1. The overfire air injector assembly 32 generally includes an OFA inlet port 34 that receives overfire air from the air duct 17 on an outer sidewall, e.g., the front and rear walls, of the structure 11 of the combustion system 10. The air inlet port 34 may be arranged to face into the flow of the air in the duct 17. For example, the inlet port may face downward into the upwardly flowing air in duct 17.

Turning vanes 36, in the inlet port 34 of a hollow elbow conduit 42, turn the overfire air to a direction, e.g., horizontal, that is preferably substantially perpendicular to the flow of flue gases moving up through the structure 11 of the combustion system 10. An annular flange 44 on the elbow conduit provides a coupling for a hollow frustoconical air duct 46 that extends towards a hollow cylindrical end section 48 of the overfire air injector assembly 32. The cylindrical end section includes a flange 50 that provides a coupling mount for the assembly 32 to the wall of the structure 11 of the combustion system 10. For example, the cylindrical end section 48 fits into a circular aperture in the structure wall and the flange 50 is bolted to a mounting ring on the wall and at the circumference of the wall aperture.

The distal end 52 of overfire air injector assembly 32 is hollow and extends a short distance, e.g., one-half to three meters, beyond the wall of the structure and into the flue gas stream. Overfire air is discharged from the distal end 52 and into the flue gas stream at the burnout zone 28, as is shown in FIG. 1. An N-agent injector, e.g., a pipe (not shown) extending through and coaxial with the cylindrical end section 48, is shown in FIG. 1 and may be included in the overfire injector assembly 32.

An inner cylindrical air duct 54 extends through the frustoconical duct 46 and cylindrical end section 48. The cylindrical air duct has an air outlet aligned with the distal end 52 of the cylindrical end section. The cylindrical air duct 54 has an inner overfire air passage 56 that extends through the duct from an inlet 58 to the duct. The duct inlet 58 may extend into the interior of a hollow elbow conduit 42. An axially movable damper 60 for the air duct 54 is positioned at the inlet 58.

An annular outer overfire air duct 62 extends between the air duct 54 and an inner wall of the cylindrical end section 48 and an inner wall of the frustoconical duct 46. A swirler 64, e.g., radial array of vanes, may be positioned in the outer overfire air duct 62 to impart a rotation to the overfire air flowing through the outer duct 62. While not shown, a swirler may be positioned in the inner overfire air passage 56. An annular damper 66 may be near the inlet (aligned with flange 44) to the outer overfire air duct 62 to regulate the volumetric rate of overfire air through the duct 62. The damper 66 may be adjusted, e.g., between closing offer overfire air flow to duct 62 and fully open to such air flow, by an actuator 40. The actuator 40 may include a separate actuation arm and hydraulic servo for each damper/louver system controlled by the actuator 40.

Figure 4:
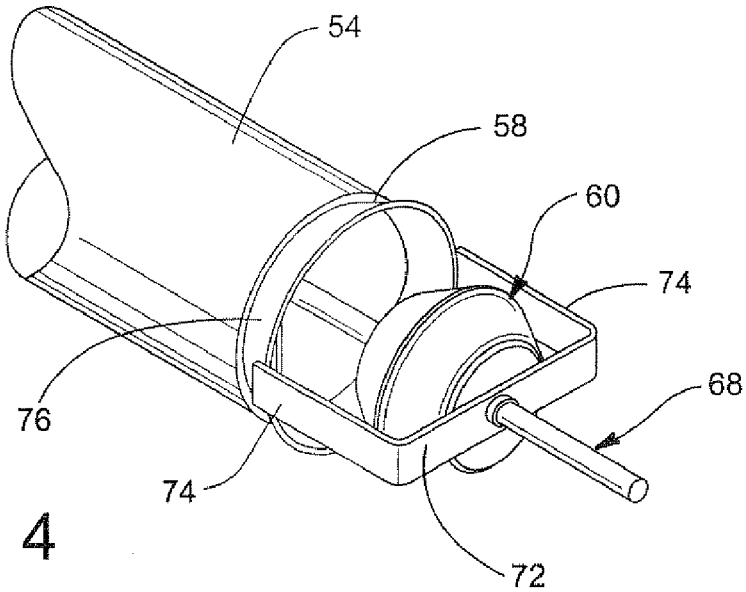
FIG. 4 is a perspective view of the side and inlet end of the inner cylindrical air duct.
Figure 5:
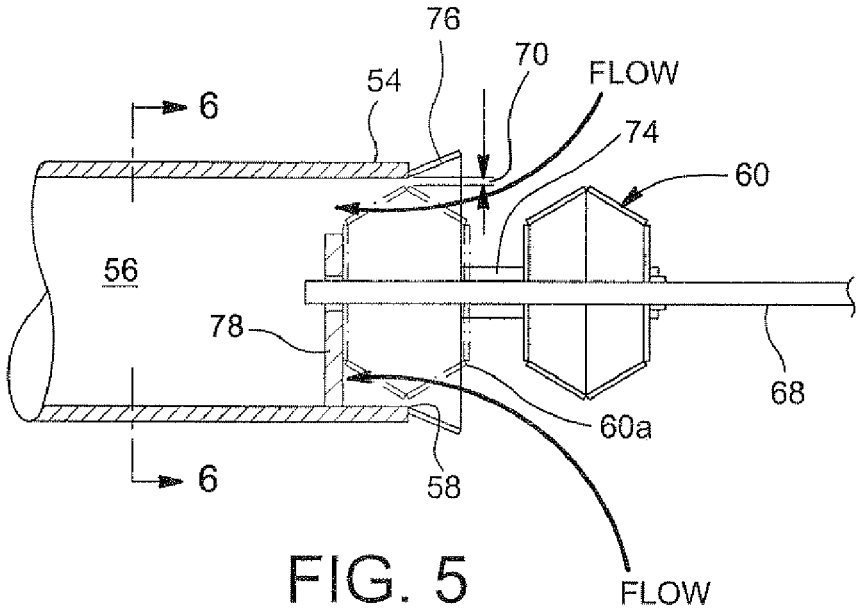
FIG. 5 is a cross-sectional side view of the inner cylindrical air duct shown in FIG. 4.
Figure 6:
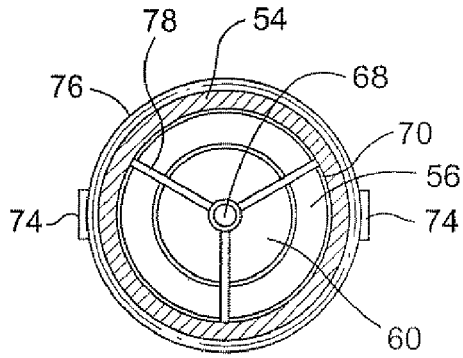
FIG. 6 is cross-sectional view of inner cylindrical air duct taken along line 6-6 in FIG. 5.

FIG. 4 is a perspective view of the side and inlet end 58 of the inner cylindrical air duct 54, FIG. 5 is a cross-sectional side view of the duct 54 near the inlet end 58, and FIG. 6 is cross-sectional view of duct 54 taken along line 6-6 in FIG. 5.

The damper 60 is axially mounted on a damper control rod 68. The control rod and damper may slide in and out of the inlet 58 of the inner cylindrical duct 54. The damper 60 is shown fully open in FIGS. 3, 4 and 5. The damper shown in phantom lines and designated as in position 60*a* in FIG. 5 is shown in a closed position that substantially closes off the overfire air flowing through duct 54.

Even with the damper 60 at the fully closed (see damper in position 60*a*, a cooling gap 70 may be formed between the outer periphery of the damper 60 and the inner wall of inlet 58 to the duct 54. Air passes through the cooling gap while the damper is in a closed position 60*a* to cool the end of the duct 54 which is exposed to the radiant heat energy of the combustion in the combustion system.

The rod 68 is supported by a U-shaped mounting bracket 72 having legs 74 that attach to a quarl ring 76. The quarl is a furstoconical metal collar that guides the overfire into the inlet 58 from the elbow conduit 42 (FIG. 3). The quarl 76 may be fixed to the inlet 58 such as by welding. A radial spoke bracket 78 provides a mount for the damper rod 68 that is opposite to the mount provided by the U-shaped bracket. The spoke bracket 78 has narrow spokes, e.g., three spokes, each with an outer radial end attached to an inside surface of the duct 54. The inner ends of the spokes support a cylindrical bearing that supports the rod 68.

An actuator 82 (See FIGS. 2 and 3) moves the damper 60 and optionally the rod 68 to position the damper with respect to the inlet of the 58 of the inner cylindrical duct 54. The damper may be moved axially with respect to the duct 54 by manually moving a hand lever (such as is shown in FIG. 2) or by a servomotor that is remotely controlled by a computer control system that may also controls other dampers and louvers for the air supply to the combustion system. The actuator positions the damper to regulate the volumetric rate of overfire air flowing through the inner overfire air passage 56. In the fully open damper position shown in FIGS. 3, 4 and 5 (see reference numeral 60), the damper allows a maximum rate of overfire air to flow through the passage 56. By advancing the damper axially along the axis of the rod 68, the rate of overfire air entering the passage 56 can be progressively reduced. By advancing the damper to closed position 60*a*, the rate of overfire air is minimized such that only a minimal volumetric rate of air flows through passage 56. The actuator allows the duct to be positioned at any axial location between the fully open position (see reference numeral 60) and the fully closed position (see reference numeral 60*a*).

The position of the damper 60 with respect to the inlet 58 may be adjusted to account for changes in the operation of the combustion system 10. For example, as the load on the boiler changes, the damper may be adjusted axially in or out to reduce or increase the amount of overfire air entering the flue gases in the combustion system. Further, the damper may be adjusted to provide enhanced emission controls, e.g., nitrous oxide (NOx) control, which may be achieved by increasing or reducing the amount of overfire air entering the flue gases.

The shape of the damper 60 may be such that the outer perimeter of the damper has a diameter that is slightly, e.g., within one quarter inch, smaller than an inside diameter of the duct 54. The damper may be circular in front view and preferably has a front view shape substantially similar to the interior cross-sectional shape of duct 54. The damper may have a simple, convex polygon shape as shown in FIG. 5, and may be shaped as a sphere, "football" in cross-section, oval in cross-section, or other shape that slides into the open inlet 58 of the of the duct 54. The shape of the damper and the movement of the damper by the actuator may be designed such that the rate of overfire air flow through the passage 56 is dependent on the position of the damper with respect to the inlet. Preferably, the distance that the damper 60 is advanced towards the inlet 58 is proportional, and most preferably linearly proportional, to the reduction or increase in the overfire air rate entering the passage 56.

Figure 7:
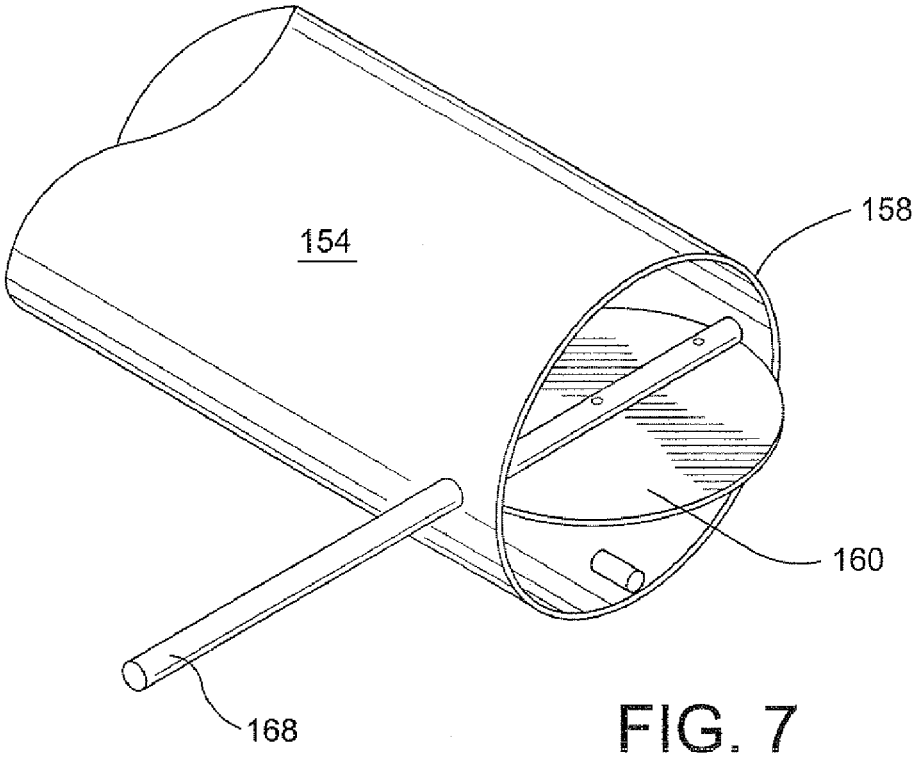
FIG. 7 (PRIOR ART)
FIG. 7 is a front, side perspective view of an overfire air tube with a conventional damper.
Figure 8:
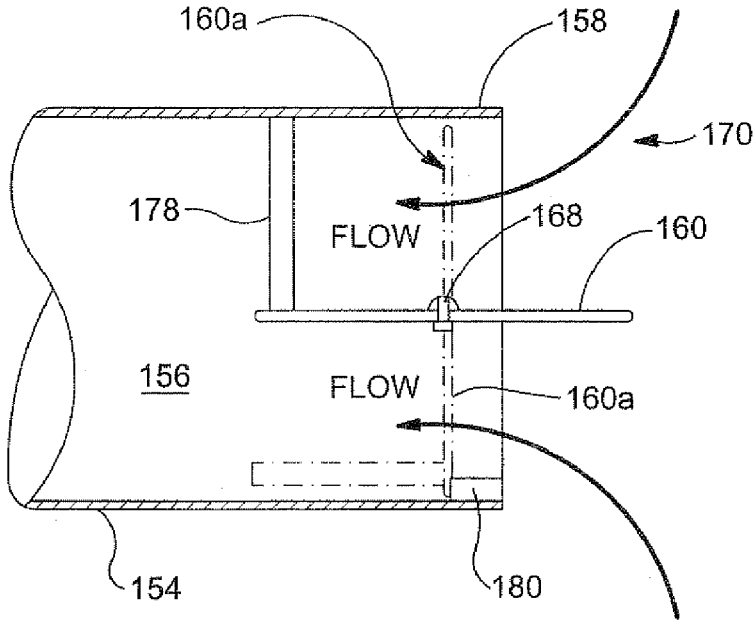
FIG. 8 (PRIOR ART)
FIG. 8 is a side view showing in cross section the overfire air tube, shown in FIG. 7.

FIG. 7 shows the prior art and is a perspective view of the side and inlet end of an inner overfire air passage 154 having an inlet end 158. A conventional disc damper 160 (sometimes referred to as a "flapper") is mounted on a rod 168 that is transverse to the axis of the duct 154. By turning the rod 168, the disc damper 160 can be rotated from a fully open position (as shown in FIG. 7 and by the solid line damper 160 shown in FIG. 8) to a fully closed position (shown by the broken line damper 160*a* shown in FIG. 8). A radial post 178 stops the damper in a fully open position and a corner block 180 stops the damper in a fully closed position. In the fully closed position 160*a*, a small annular cooling gap 170 remains between the outer perimeter of the disc and the inner wall of the inlet 158 to the duct 154. The cooling gap allows a small amount of overfire air to flow through passage 156 to provide cooling to the inlet 158 which is exposed to the radiant heat of the combustion flames in the combustion system.

The conventional disc damper 160 tends not to provide proportional flow control for the overfire air flowing through the passage 156. In particular, the disc damper tends to rapidly allow substantially a full air flow through the passage as the disc is rotated away from the fully closed position 160*a*.

There is a long felt need for an inlet damper that provides proportional flow control of overfire air entering an inner overfire air passage. This need is believed to be satisfied by the damper 60 shown in FIGS. 2 to 6. The damper 60 shown in FIGS. 2 to 6 and the axial movement of the damper 60 provides proportional flow control because axial movement of the damper can proportionally adjust the volumetric flow rate of overfire air in the passage 56. For example, a mid-point in the movement of the damper 56 along the axis of the rod 68 reduces the overfire air through passage 56 to about one-half the volumetric airflow of the passage when the damper is fully extended away from the inlet 58 (as is shown in FIG. 5). One advantage of the axial movement and shape of damper 60 over the shape and rotational movement of damper 162 is proportional control of overfire air in passage 56, 156.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A damper and overfire air duct assembly in a combustion system having a combustion structure defining a flue gas passage, the damper and overfire air duct assembly comprising:

an outer overfire air duct having an inlet and an outlet discharging overfire air into the flue gas passage, wherein the overfire air duct has a longitudinal axis extending through the inlet:

an inner overfire air duct enclosed by and concentric to the outer overfire air duct, wherein the inner overfire air duct has an inlet and an outlet discharging overfire air into the flue gas passage, and a damper aligned with the longitudinal axis of the outer overfire air duct, and having an open position in which the damper extends axially outward of the inlet to the inner overfire air duct, and a closed position in which the damper is at least partially in the inlet to the inner overfire air duct, wherein the damper is movable axially along the longitudinal axis between the open and closed positions.

2. A damper and overfire air duct assembly as in claim 1 wherein the damper is mounted on a rod coaxial to the longitudinal axis of the outer overfire air duct.

3. A damper and overfire air duct assembly as in claim 2 wherein the rod is supported by at least one of a U-shaped bracket and a spoke bracket, wherein both of the brackets extend axially outward of the inlet to the inner overfire air duct.

4. A damper and overfire air duct assembly as in claim 1 further comprising an actuator moving the damper axially to various positions including and between the open and closed positions.

5. A damper and overfire air duct assembly as in claim 4 wherein the actuator is manually operated to move the axial position of the damper.

6. A damper and overfire air duct assembly as in claim 4 wherein the actuator is remotely controlled to move the axial position of the damper.

7. A damper and overfire air duct assembly as in claim 1 wherein the damper is a polygon in cross section.

8. A damper and overfire air duct assembly as in claim 7 wherein the damper has a shape selected from a group consisting of simple, convex polygon shape in cross-section, a sphere, a football shape in cross-section, and an oval in cross-section.

9. An overfire air duct and damper assembly in a combustion system having a combustion structure defining a flue gas passage, the overfire air duct and damper assembly comprising:

an outer overfire air duct including an air inlet and an outlet discharging overfire air into the flue gas passage, wherein the overfire air duct has a longitudinal axis extending through the inlet:

an inner overfire air duct including an air inlet and an outlet discharging overfire air into the flue gas passage, wherein the overfire air duct is enclosed, by and is coaxial with the outer overfire air duct, and a damper aligned with the longitudinal axis of the inner and outer overfire air ducts, and having an open position in which the damper extends axially beyond the inlet and to the inner overfire air duct, and a closed position in which the damper extends at least partially into the inlet of the inner overfire air duct, wherein the damper is movable axially between the open and closed positions.

10. An overfire air duct and damper assembly as in claim 9 wherein the an outer annular damper is aligned with the air inlet to the outer overfire air duct and extends around the inner overfire air duct, wherein the outer damper is operable separately from the inner damper.

11. An overfire air duct and damper assembly as in claim 9 wherein the inlet to the inner overfire air duct is within an elbow joint of an overfire air injector assembly, the overfire air injector assembly is mounted on a wall of the combustion structure, and the outer overfire air duct is connected overfire air injector assembly.

12. An overfire air duct and damper assembly as in claim 9 wherein the damper is mounted on a rod coaxial to the longitudinal axis of the outer overfire air duct.

13. An overfire air duct and damper assembly as in claim 9 further comprising an actuator moving axially in the damper to position the damper at various positions including the open and closed positions.

14. An overfire air duct and damper assembly as in claim 9 wherein the damper is a polygon in cross section.

* * * * *